US010604322B2

(12) United States Patent
Baner et al.

(10) Patent No.: US 10,604,322 B2
(45) Date of Patent: Mar. 31, 2020

(54) TRIPLE-FOLDED HOT AIR SEALED THERMOPLASTIC BAGS

(71) Applicant: Societe des Produits Nestle S.A., Vevey (CH)

(72) Inventors: Albert Lawrence Baner, Wildwood, MO (US); Russell Leeker, Fenton, MO (US); Scott Wiles, St. Louis, MO (US)

(73) Assignee: Societe des Produits Nestle S.A., Vevey (CH)

( * ) Notice: Subject to any disclaimer, the term of this patent is extended or adjusted under 35 U.S.C. 154(b) by 196 days.

(21) Appl. No.: 14/919,022

(22) Filed: Oct. 21, 2015

(65) Prior Publication Data

US 2017/0113859 A1 Apr. 27, 2017

(51) Int. Cl.

| | |
|---|---|
| ***B65D 77/00*** | (2006.01) |
| ***B65D 77/12*** | (2006.01) |
| ***B65B 7/02*** | (2006.01) |
| ***B65B 51/10*** | (2006.01) |
| ***B65D 75/12*** | (2006.01) |
| ***B65D 33/18*** | (2006.01) |

(52) U.S. Cl.

CPC ..... *B65D 77/12* (2013.01); *B65B 7/02* (2013.01); *B65B 51/10* (2013.01); *B65D 33/18* (2013.01); *B65D 75/12* (2013.01)

(58) Field of Classification Search

CPC .... B65D 31/04; B65D 2313/02; B65D 33/02; B65D 33/20; B65D 33/30

USPC ..... 383/88

See application file for complete search history.

(56) References Cited

U.S. PATENT DOCUMENTS 3,807,626 A * 4/1974 Goodrich ..... B65D 75/68 383/111
3,910,488 A * 10/1975 Goodrich ..... B65D 75/68 383/111
3,938,659 A * 2/1976 Wardwell ..... B65D 75/5855 206/439
4,850,944 A * 7/1989 Osborn ..... B29C 66/73921 156/497
4,875,587 A * 10/1989 Lulham ..... A22C 13/0013 206/484
5,058,361 A * 10/1991 Schmacher ..... B29C 65/10 53/370.9

(Continued)

FOREIGN PATENT DOCUMENTS

EP 00953429 B1 6/2004
WO 2007006060 A1 1/2007

(Continued)

*Primary Examiner* — Peter N Helvey
(74) *Attorney, Agent, or Firm* — Ronald A. Burchett

(57) ABSTRACT

A method for sealing a thermoplastic bag includes forming a first fold in a top end of the bag; forming a second fold in the top end that includes the first fold; folding the first fold to form a first portion of the first fold and a second portion of the first fold, the second portion of the first fold is folded onto the first portion of the first fold; and heat sealing the first fold and the second fold to each other and to a portion of the bag that faces the first fold, the heat sealing including applying hot air to the bag. Preferably the second fold has a height that is less than a height of the first fold such that the forming of the second fold folds the first fold to form the first and second portions of the first fold.

13 Claims, 9 Drawing Sheets

(56) References Cited

U.S. PATENT DOCUMENTS

| | | | | |
|---|---|---|---|---|
| 6,715,919 | B2 * | 4/2004 | Hiraiwa | B65D 31/04 383/116 |
| 6,793,392 | B1 * | 9/2004 | Porret | B65D 33/16 383/61.1 |
| 2002/0011048 | A1 | 1/2002 | Koehn | |
| 2007/0274614 | A1 | 11/2007 | Abel | |
| 2008/0260305 | A1 * | 10/2008 | Shah | B65D 33/002 383/211 |
| 2010/0205909 | A1 * | 8/2010 | Zimmerman | B65D 33/20 53/434 |
| 2010/0320260 | A1 * | 12/2010 | Moghaddam Javid | A47J 36/06 229/87.08 |
| 2011/0103717 | A1 * | 5/2011 | Kasai | B65D 33/2591 383/64 |
| 2012/0227363 | A1 | 9/2012 | Nussbaum | |
| 2013/0022295 | A1 * | 1/2013 | Shapiro | B65D 31/10 383/203 |
| 2013/0031875 | A1 | 2/2013 | Sargin | |
| 2014/0072247 | A1 * | 3/2014 | McDonough | B65D 75/008 383/210.1 |
| 2016/0137374 | A1 * | 5/2016 | Brosch | B65D 75/002 383/104 |

FOREIGN PATENT DOCUMENTS

| | | | |
|---|---|---|---|
| WO | 2010086794 | A1 | 8/2010 |
| WO | 2011060460 | A1 | 5/2011 |

* cited by examiner

TRIPLE-FOLDED HOT AIR SEALED THERMOPLASTIC BAGS

BACKGROUND

The present disclosure relates generally to thermoplastic packages or bags that are triple-folded and sealed by hot air to provide resistance to insect infestation and methods for making such packages or bags.

Product packaging is important with respect to the storage of the product contained therein. Packages that are easy to open and enable a consumer to easily access a product contained in the package are particularly popular. However, the packaging should also be tightly sealed to help maintain the freshness of the product stored in the packaging, especially with products such as comestible products or food products for which product freshness and consistency is highly desirable.

Polywoven bags can be manufactured that exhibit excellent tensile strength qualities making them very suitable for containing a wide variety of materials. However, many closures of polywoven bags form holes in the bag that can allow insects and their larvae to enter the bag.

Grain-based insects are separated into two categories, penetrators and invaders. Invaders are insects that typically have weakly developed mouth-parts at both the larval and adult stages. The invaders, such as Indian meal moths and red flour beetles, account for more than 75% of the infestations of polywoven bags. Invaders commonly enter packages through openings resulting from mechanical damage, defective seals, or holes made by other insects penetrating the package. The newly hatched larvae of invaders typically cause the most damage because they are able to fit through holes as small as 0.1 mm wide.

Most infestations are the result of invasion through seams and closures, and rarely through penetrations. For example, the adult saw-toothed grain beetle has been shown to enter packaging through openings less than 1 mm in diameter, and the adult red flour beetle can enter holes in packaging that are less than 1.35 mm in diameter. Many insects prefer to lay eggs in tight spaces, such as those formed when bags are folded to create closures. These refuges provide a safe place to lay eggs and also give the newly hatched larvae an ideal location to invade the packages.

Insects will take advantage of any sort of opening in a packaging material in order to gain entry. These openings may form as a result of rips, tears, or poor seals or as punctures resulting from normal wear and tear throughout the handling process. Openings in packaging may also be made deliberately in the form of "vents" which allow pressure equalization and air escapement deflation. These vents allow creation of a stable pallet and avoid the bursting or shrinking of the bag during shipment over changing altitudes. However, when an insect "smells" food, the insect will try to reach it. The vent holes are made to reduce bursting and provide a means for air deflation palletizing but they also allow odors to escape, attracting insects and providing an access point for entry.

SUMMARY

In a general embodiment, the present disclosure provides a method for sealing a thermoplastic bag. The method comprises: forming a first fold in a top end of the bag; forming a second fold in the top end comprising the first fold; folding the first fold to form a first portion of the first fold and a second portion of the first fold, the second portion of the first fold is folded onto the first portion of the first fold; and heat sealing the first fold and the second fold to each other and to a portion of the bag that faces the first fold, the heat sealing comprising applying hot air to the bag. This closure is generally referred to as a "triple-fold" throughout the present application. In an alternative embodiment, the folding can be employed in combination with another type of sealing method besides heat sealing, for example adhesive applied while sealing or before sealing and reactivated with heat, or taping as another example.

In an embodiment, the second fold has a height that is less than a height of the first fold.

In an embodiment, the forming of the second fold folds the first fold to form the first and second portions of the first fold.

In an embodiment, the first portion of the first fold, the second portion of the first fold, and the second fold are formed using only two folding operations.

In an embodiment, the hot air is applied directly to the portion of the bag that faces the first fold.

In an embodiment, the hot air is applied directly to the first portion of the first fold.

In an embodiment, the method comprises subjecting the top end of the bag to a cooling device after the hot air has been applied.

In an embodiment, the hot air has a temperature great enough to melt the surface of the thermoplastic material on the outside of the bag In another embodiment, a sealed thermoplastic bag is provided by the present disclosure. The bag comprises: a first panel; a first fold comprising a first portion and further comprising a second portion folded onto the first portion, the first fold faces a portion of the first panel; a second fold on an opposite side of the first fold relative to the portion of the first panel that faces the first fold; and the first portion of the first fold, the second portion of the first fold, and the second fold have been heat sealed by hot air to each other and to the portion of the first panel that faces the first fold.

In an embodiment, the first portion of the first fold and the second portion of the first fold have the same top edge.

In an embodiment, the second fold and the first portion of the first fold have the same bottom edge.

In an embodiment, the second fold and the portion of the first panel that faces the first fold have the same top edge.

In an embodiment, the second portion of the first fold comprises a bottom edge comprising an opening of the bag that is closed by the heat seal.

In an embodiment, the bag comprises vents positioned in a section of the bag selected from the group consisting of the first fold, the second fold, the portion of the first panel that faces the first fold, and combinations thereof. In an embodiment, at least one of the vents is positioned at a center of the sealed thermoplastic bag such that a distance to a left side of the bag is about the same as a distance to a right side of the bag.

In an embodiment, the bag comprising gussets that connect the first panel to a second panel of the sealed thermoplastic bag, the second panel forming an opposite side of the sealed thermoplastic bag relative to the first panel, the bag comprising vents positioned in a part of the gussets that is above a bottom edge of the first fold.

In another embodiment, a method for packaging a product is provided by the present disclosure. The method comprises: filling the product into a thermoplastic bag that comprises a first panel, a second panel opposite to the first panel, and vents; forming a first fold in a top end of the thermoplastic bag; forming a second fold in the top end comprising the first fold, the second fold having a height that is less than a height of the first fold, the first fold and the second fold are formed such that a portion of the first panel faces the first fold and such that at least a portion of the vents are positioned in a section of the bag selected from the group consisting of the first fold, the second fold, the portion of the first panel that faces the first fold, and combinations thereof; and applying hot air to the thermoplastic bag to heat seal the first fold and the second fold to each other and to the portion of the first panel that faces the first fold. In an alternative embodiment, the folding can be employed in combination with another type of sealing method besides heat sealing, for example adhesive applied while sealing or before sealing and reactivated with heat, or taping as another example.

In an embodiment, the bag comprises gussets that connect the first panel to the second panel, and the forming of the second fold positions a portion of the vents in a part of the gussets that is above a bottom edge of the second fold.

In an embodiment, the forming of the second fold comprises folding the first fold to form a first portion and a second portion of the first fold, the second portion folded onto the first portion.

In an embodiment, the applying of the hot air comprises sealing a bottom edge of the second portion of the first fold at a position between the second fold and the first portion of the first fold, and the bottom edge of the second portion of the first fold comprises an opening of the bag that is closed by the heat seal and accessed by pulling the first and second folds away from the portion of the first panel that faces the first fold.

Thermoplastic bags of the present invention can be made of any thermoplastic material, including but not limited to, woven thermoplastic, non-woven thermoplastics, and thermoplastic coatings, lamination or adhesive on a non-thermoplastic material.

An advantage of the present disclosure is to provide an improved sealed thermoplastic bag and an improved method for making a sealed thermoplastic bag.

A further advantage of the present disclosure is to provide a tighter seal on one or both ends of a thermoplastic bag without increasing the cost per bag.

Still another advantage of the present disclosure is to provide a tighter seal on one or both ends of a thermoplastic bag that meets production demand requirements and quality specifications.

Yet another advantage of the present disclosure is to reduce insect infestation and the odors that attract insects by improving the seal tightness.

Another advantage of the present, disclosure is to make a package more visually appealing while reducing product contamination by improving the seal tightness.

Yet another advantage of the present disclosure is to reduce seal complaints.

Another advantage of the present disclosure is to provide a more sustainable thermoplastic bag.

A further advantage of the present disclosure is to improve the seal tightness using double fold bag sealers with no loss in throughput or efficiency.

Still another advantage of the present disclosure is to provide a sealed thermoplastic bag more resistant to infestation of grain-based insects.

Still another advantage of the present disclosure is to seal a thermoplastic bag without the use of additional materials (e.g. tape, adhesive) which are additional material costs for bag closing.

Yet another advantage of the present disclosure is to make the pathway to the inside of the bag more difficult for crawling insects.

Another advantage of the present disclosure is to provide a method for folding and sealing a bag that is not as sensitive to bag skewness of incoming bags from a bag filler relative to other bag closing methods.

A further advantage of the present disclosure is to provide a seal that is more air tight as compared to a double fold and seal.

Another advantage of the present disclosure is to limit or prevent insect infestation but still eliminate excessive air in the bag after the bag has been filled and sealed.

Yet another advantage of the present disclosure is to provide venting that allows removal of entrapped air in the headspace of the heat-sealed bag without creating a path to allow insect infestation, by burying the vent in the seal in such a manner that when the bag is squeezed or other bags are stacked on the bag, the air can force its way out of the bag through the vent.

Additional features and advantages are described herein and will be apparent from the following Detailed Description and the Figures.

DETAILED DESCRIPTION

As used in this disclosure and the appended claims, the singular forms "a," "an" and "the" include plural referents unless the context clearly dictates otherwise. The words "comprise," "comprises" and "comprising" are to be interpreted inclusively rather than exclusively. Likewise, the terms "include," "including" and "or" should all be construed to be inclusive, unless such a construction is clearly prohibited from the context. However, the devices disclosed herein may lack any element that is not specifically disclosed. Thus, a disclosure of an embodiment using the term "comprising" includes a disclosure of embodiments "consisting essentially of" and "consisting of" the components identified.

Figure 1A:
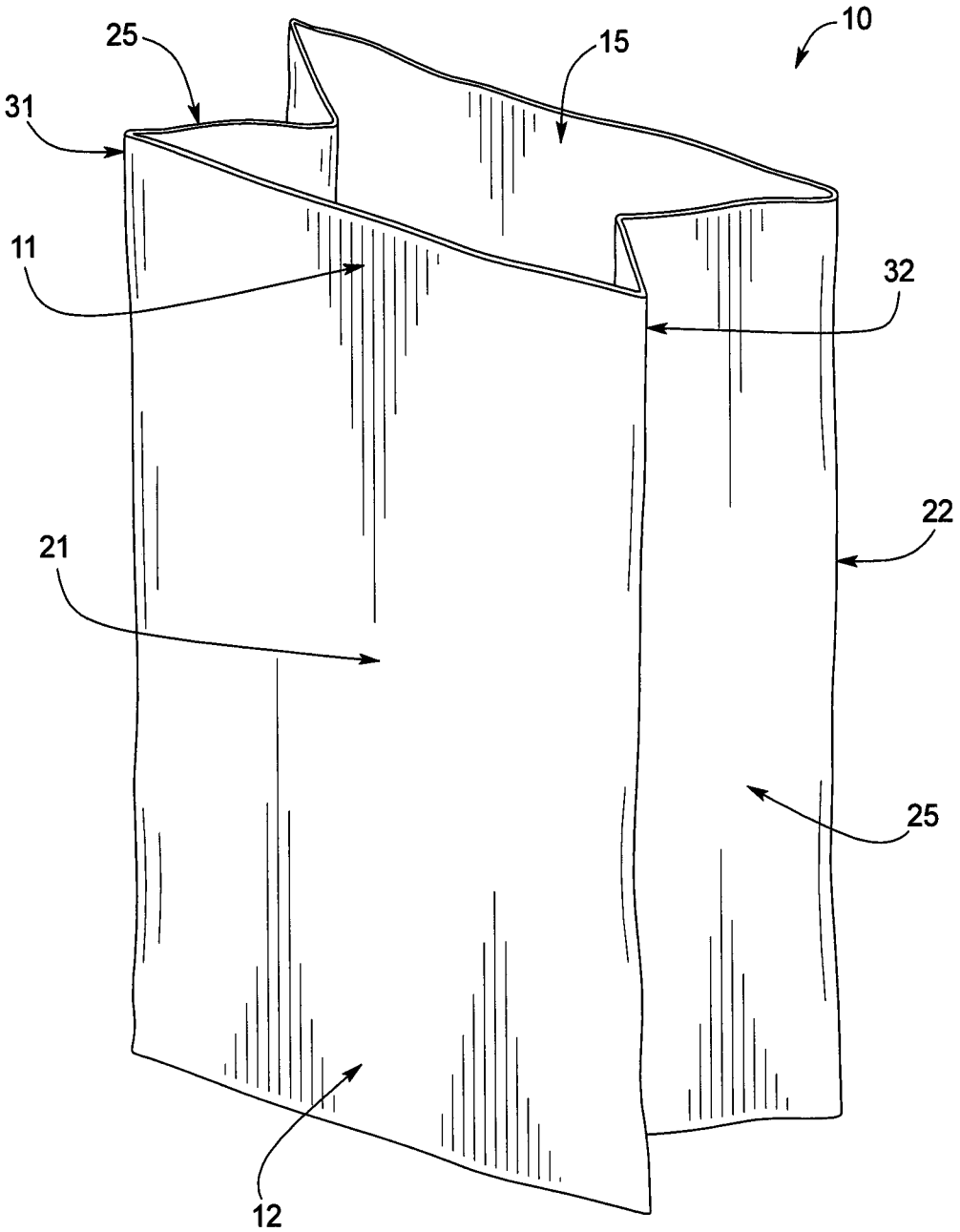
FIGS. 1A, 2A, 3A and 4A show front perspective views of thermoplastic bags in embodiments provided by the present disclosure.
Figure 1B:
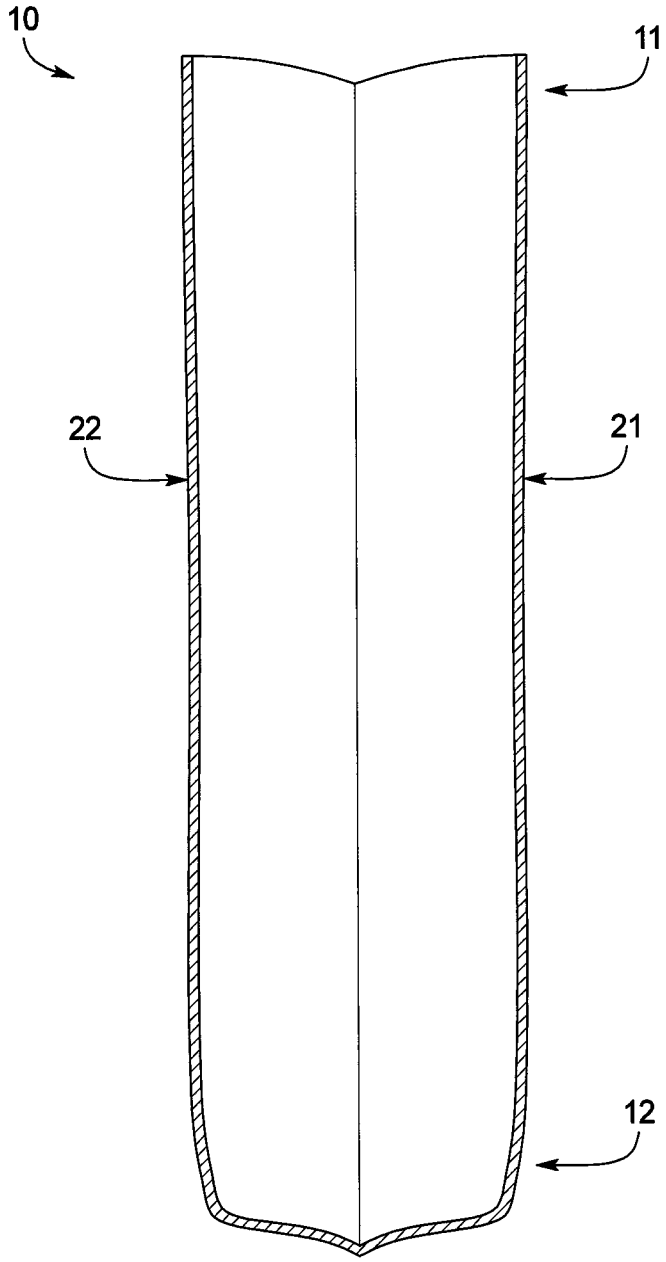
FIGS. 1B, 2B, 3B and 4B show side cross-section views of FIGS. 1A, 2A, 3A and 4A, respectively.

FIGS. 1A and 1B show an embodiment of a package or bag 10 (hereafter "the bag 10") that can be sealed according to the present disclosure. In an embodiment, the bag 10 has an interior containing or capable of containing a product such as, for example, human food; pet food, such as companion animal food, such as cat food, dog food, and the like; or non-consumable products. The bag 10 can have a variety of sizes, capacities and shapes. In an embodiment, the bag 10 is substantially rectangular.

The bag 10 comprises thermoplastic material, preferably polypropylene, more preferably woven polypropylene.

The polypropylene can have many variations to the thicknesses of the different layers. Many types of polymers, copolymers, inks, polymer blends, single or coextrusion lamination layers, and primers can be used. Furthermore, the polypropylene can have various weights and threads per inch.

The polypropylene material can be made by printing the bi-axially oriented polypropylene (BOPP), extruding and weaving the fabric, and then combining these two material streams together by extrusion lamination using a molten stream of a polypropylene blend that is fed through a slit die before the material is pinched together between two lamination rollers. Alternatively, these materials can be laminated together by adhesive, especially the BOPP and a coated fabric layer.

A flattened tube of fabric can be laminated with a layer of reverse-printed BOPP. Finished printed material can be flat and is preferably formed into a tube by a converter before making the material into a bag. Simultaneously, side gussets can be placed in the tube, and then the tube can be flush cut. Then one end of the bag can be passed through a bottomer which then closes one end of the bag.

As shown in FIGS. 1A and 1B, the bag 10 has a top end 11 which can be formed by a first panel 21 and a second panel 22 of the bag 10 and which can made of the thermoplastic material, preferably polypropylene, more preferably_ woven polypropylene. The remaining portions of the bag 10 can also be made of the thermoplastic material, which can make the bag 10 flexible. In an embodiment, the first panel 21 and the second panel 22 each extend from the top end 11 to the bottom end 12 of the bag 10.

After the bag 10 is filled and sealed as discussed hereafter, the bag 10 can be sold to a consumer. The consumer can open the top end 11 of the bag 10 and use an opening 15 between the first panel 21 and the second panel 22 to obtain at least a portion of product contained by the bag 10.

The first panel 21 can be at least partially connected to the second panel 22 by gussets 25 connected to a first lateral side 31 and a second lateral side 32 of the bag 10. Alternatively or additionally, the first panel 21 is at least partially connected directly to the second panel 22 at the first lateral side 31 and the second lateral side 32 of the top end 11.

To close the bottom end 12 of the bag 10, the bottom end 12 can be triple-folded and hot air sealed as discussed with respect to the top end 11 in more detail later in this application. In an alternative embodiment, the bottom end 12 can be double-folded and then heat sealed or taped. In another alternative embodiment, a pinch step cut can be made in the bottom end 12 of the bag 10, and the bottom end 12 can be folded once and then heat sealed.

The top end 11 of the bag 10 can be used to fill the bag 10, for example after the bottom end 12 has been closed. Alternatively or additionally, the bottom end 12 can be used to fill the bag 10 before closure of the bottom end 12. For example, the top end 11 can be sealed as discussed hereafter, then the bottom end 12 can be used to fill the bag 10, and then the bottom end 12 can be closed. The present disclosure is not limited to a specific way of filling the bag 10.

Figure 2A:
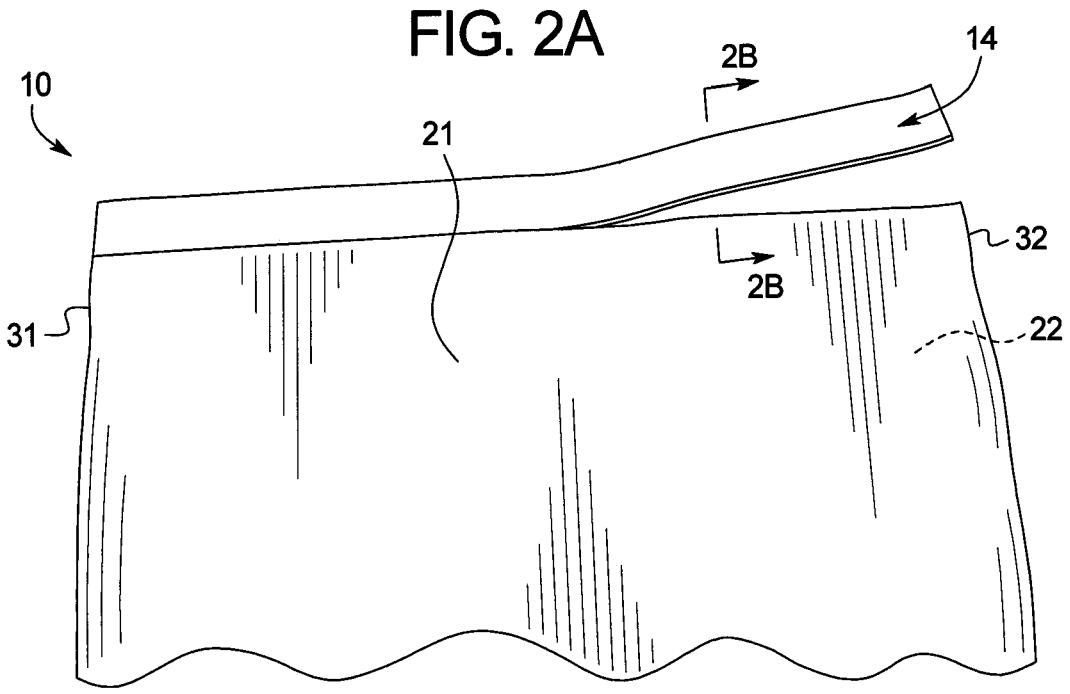
Figure 2B:
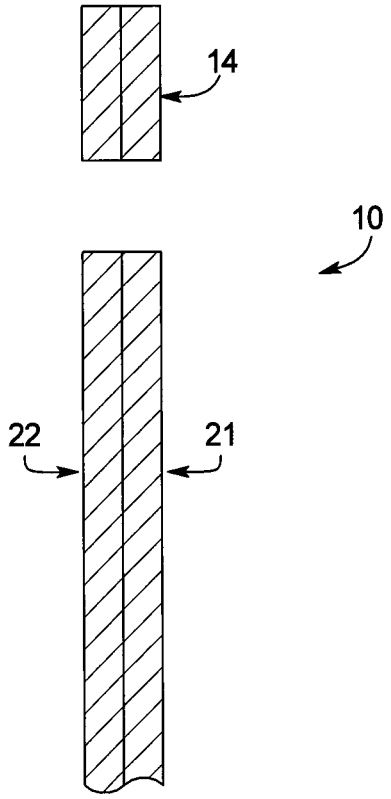

As shown in FIGS. 2A and 2B, an upper portion 14 of the bag 10 can be trimmed from the bag 10 to ensure that the top end 11 of the bag 10 is substantially straight for subsequent processing. In an embodiment, the first panel 21 is positioned against the second panel 22 at the top end 11 of the bag 10 and then the upper portion 14 of the bag 10 is trimmed from the bag 10. For example, the top edges of the first panel 21 and the second panel 22 can be placed in contact across at least a majority of the width of the bag 10, preferably across the entirety of the width of the bag 10, and then a blade can cut the upper portion 14 from the bag 10. For example, the bag 10 can be held between rollers at a position below the line where the bag 10 will be trimmed, and the rollers can move the bag 10 past a blade that cuts the upper portion 14 from the bag 10.

Figure 3A:
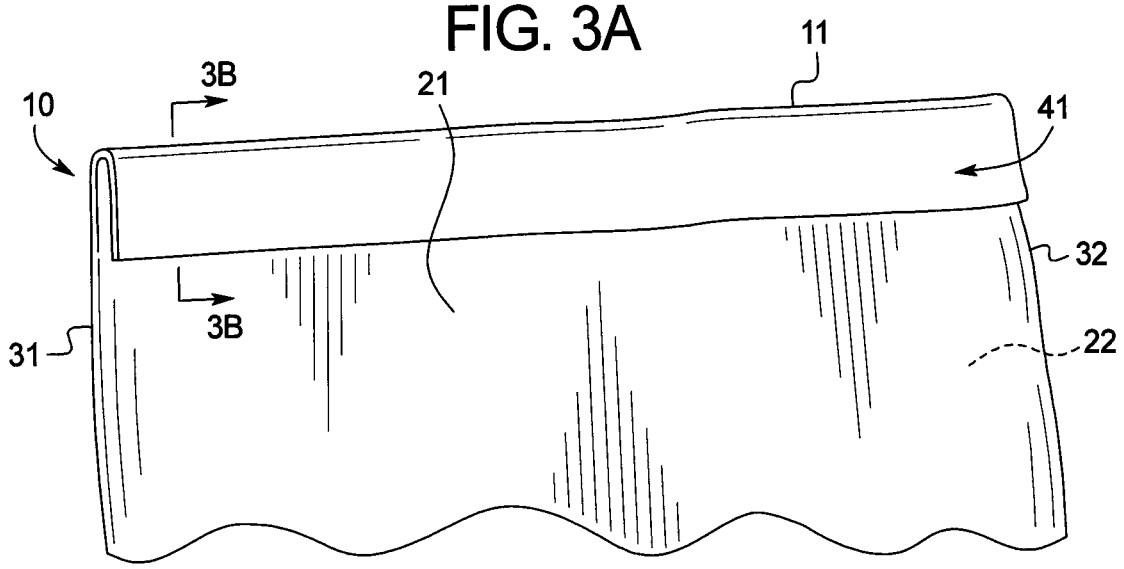
Figure 3B:
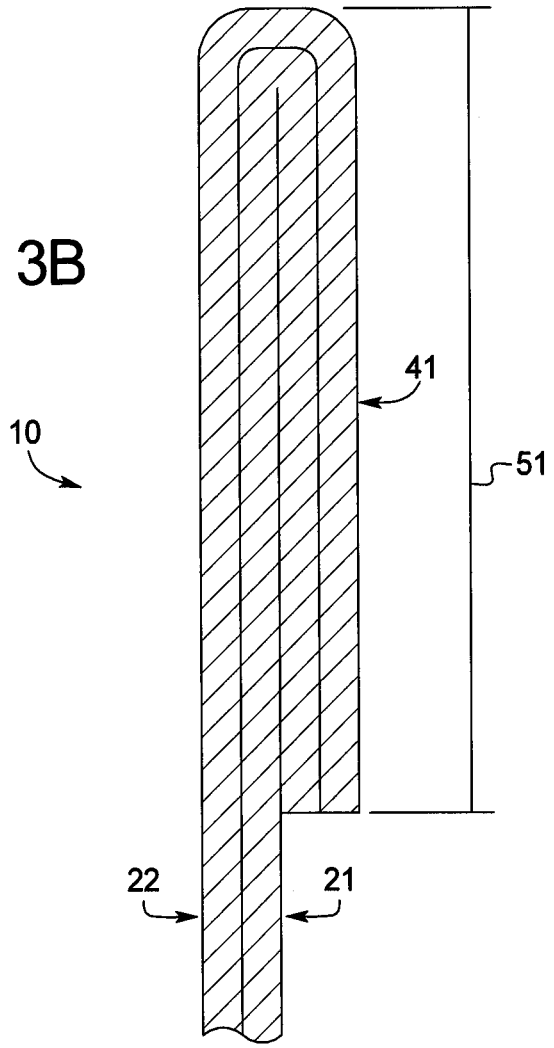

As shown in FIGS. 3A and 3B, a first fold 41 can be formed in the top end 11 of the bag 10. As should be clear from this disclosure, "the first fold 41" refers to a specific folded portion of the bag, not merely a fold line at which the bag is folded.

The first fold 41 has a height 51, such as 1⅛ inches as a non-limiting example. The first fold 41 can be a substantially rectangular portion of the bag 10 and can have lateral sides substantially parallel to the lateral sides 31, 32 of the remainder of the bag 10. The first fold 41 can be formed by folding the top end 11 of the bag 10 either direction—toward the first panel 21 or, instead, toward the second panel 22. For illustrative purposes, the following disclosure and corresponding figures are directed to the first fold 41 being formed by folding the top end 11 of the bag 10 toward the first panel 21. However, one of ordinary skill will easily understand how to apply the disclosure to an embodiment in which the first fold 41 is formed by folding the top end 11 of the bag 10 toward the second panel 22. Therefore, the present disclosure is not limited to a specific direction by which the first fold 41 is formed.

Any folding mechanism known to one of ordinary skill in the art can be used to form the first fold 41 in the top end 11 of the bag 10. For example, the top end 11 of the bag 10 can be moved through folding plates that form the first fold 41. These folding plates can be substantially vertical in an upward direction at a first end at which the top end 11 of the bag 10 enters and then, as the folding plates extend onward, the folding plates can gradually rotate 180° to be substantially vertical in a downward direction at the second end of the folding plates. For example, the folding plates can form a groove that gradually rotates from substantially upward to substantially downward as the folding plates extend from their first end at which the top end 11 of the bag 10 enters. Thus the top end 11 of the bag 10 can be moved through the folding plates such that the first fold 41 is formed in the top end 11 of the bag 10 by rotation of the folding plates. However, the present disclosure is not limited to a specific mechanism by which the first fold 41 is formed in the top end 11 of the bag 10.

Figure 4A:
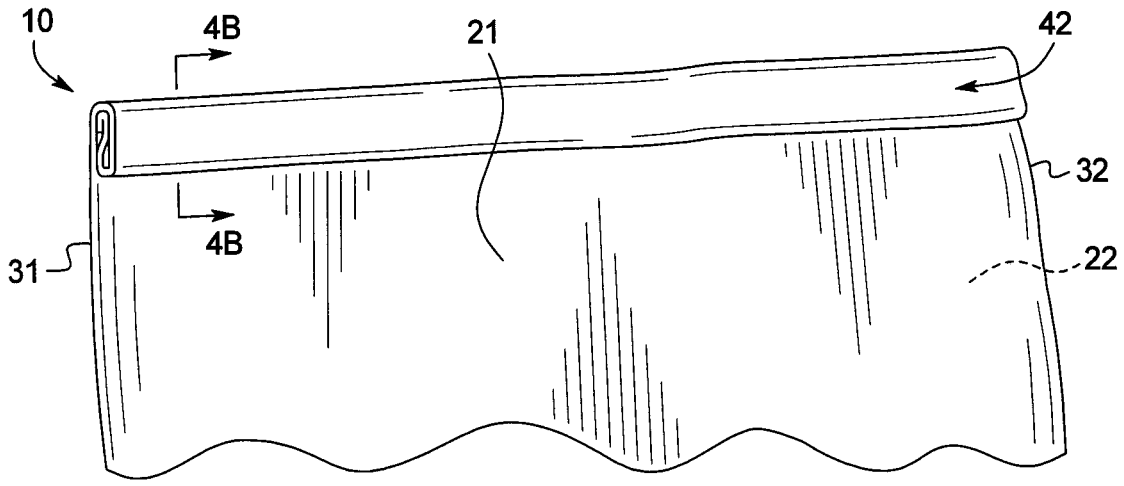
Figure 4B:
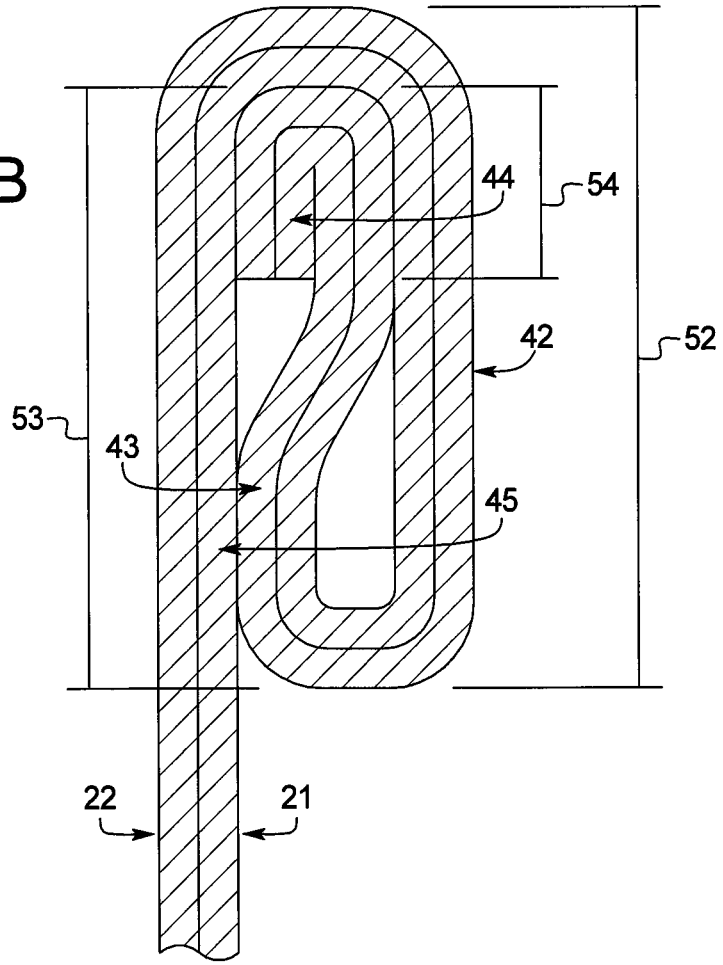

As shown in FIGS. 4A and 4B, a second fold 42 can be formed in the top end 11 of the bag 10 comprising the first fold 41. As should be clear from this disclosure, "the second fold 42" refers to a specific folded portion of the bag, not merely a fold line at which the bag is folded.

The second fold 42 is formed in the bag 10 by folding the top end 11 of the bag 10 in the same direction as the top end 11 of the bag 10 was folded to form the first fold 41. For example, if the first fold 41 was formed by folding the top end 11 of the bag 10 toward the first panel 21, the second fold 42 is formed by folding the top end 11 of the bag 10 comprising the first fold 41 toward the first panel 21. If the first fold 41 was formed by folding the top end 11 of the bag 10 toward the second panel 22, the second fold 42 is formed by folding the top end 11 of the bag 10 comprising the first fold 41 toward the second panel 22. Preferably, the second fold 42 is a substantially rectangular portion of the bag 10 and has lateral sides substantially parallel to the lateral sides 31, 32 of the remainder of the bag 10 and/or substantially parallel to the lateral sides of the first fold 41.

The second fold 42 has a height 52 that is less than the height 51 of the first fold 41. As a non-limiting example, the height 51 of the first fold 41 can be 1⅛ inches, and the height 52 of the second fold 42 can be 1 inch. The height 51 of the first fold 41 and the height 52 of the second fold 42 each can be any distance as long as the height 52 of the second fold 42 is less than the height 51 of the first fold 41.

Any folding mechanism known to one of ordinary skill in the art can be used to form the second fold 42 in the top end 11 of the bag 10 comprising the first fold 41. For example, the second fold 42 can be formed by moving the top end 11 of the bag 10 comprising the first fold 41 through folding plates additional to any folding plates used to form the first fold 41. These folding plates can be substantially vertical in an upward direction at a first end at which the top end 11 of the bag 10 comprising the first fold 41 enters and then, as the folding plates extend onward, can gradually rotate 180° to be substantially vertical in a downward direction at the second end of the folding plates. For example, these folding plates can form a groove that gradually rotates from substantially upward to substantially downward as the folding plates extend from their first end at which the top end 11 of the bag 10 comprising the first fold 41 enters. Thus the top end 11 of the bag 10 comprising the first fold 41 can be moved through the folding plates additional to any folding plates used to form the first fold 41 such that the second fold 42 is formed in the top end 11 of the bag 10. However, the present disclosure is not limited to a specific mechanism by which the second fold 42 is formed in the top end 11 of the bag 10.

As noted above, the height 52 of the second fold 42 is less than the height 51 of the first fold 41. Thus the limited space under the second fold 42 forces the first fold 41 to fold upon itself. As shown in FIG. 4B, the first fold 41 is divided into a first portion 43 and a second portion 44 as a result of the first fold 41 folding upon itself. The second portion 44 of the first fold 41 is preferably folded onto the first portion 43 of the first fold 41. One or both of the first portion 43 and the second portion 44 of the first fold 41 can be substantially rectangular portions of the bag 10 and can have lateral sides substantially parallel to the lateral sides 31, 32 of the remainder of the bag 10 and/or substantially parallel to the lateral sides of the second fold 42.

The first portion 43 of the first fold 41 can have a height 53 that is substantially the same as the height 52 of the second fold 42. In such an embodiment, the second portion 44 of the first fold 41 has a height 54 that is the remainder of the height 51 of the entirety of the first fold 41. In other words, the height 54 of the second portion 44 of the first fold 41 is the difference between (i) the height 51 of the entirety of the first fold 41 and (ii) the height 53 of the first portion 43 of the first fold 41.

Preferably, the three folds, namely the first portion 43 of the first fold 41, the second portion 44 of the first fold 41, and the second fold 42 (hereafter "the folded material") are formed in the top end 11 of the bag 10 using only two folding operations. In an alternative embodiment, three folding operations can be used, but folding thin flexible materials precisely into narrow folds can be very difficult and may require larger folds and thus more material.

Figure 5:
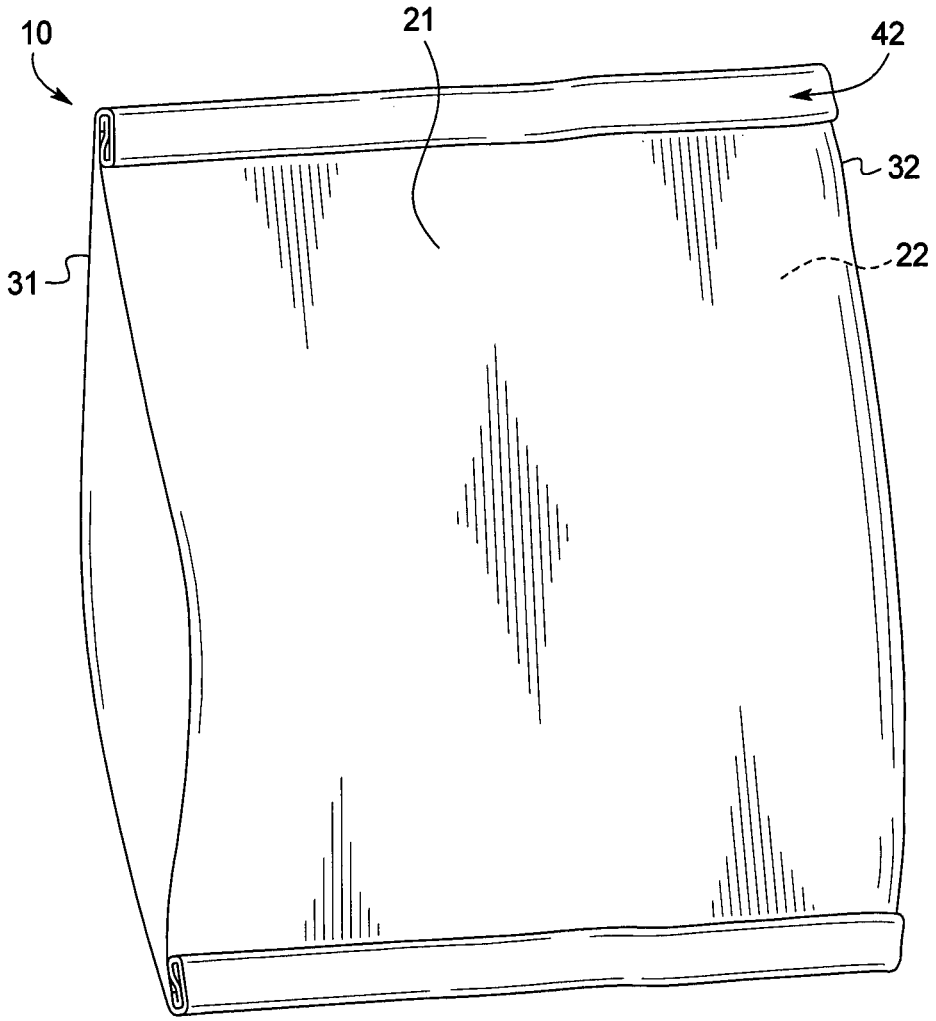
FIG. 5 shows a front perspective view of a sealed bag provided by the present disclosure.

As shown in FIG. 5, the bag 10 can be sealed by hot air heat sealing the first portion 43 of the first fold 41, the second portion 44 of the first fold 41, and the second fold 42 to each other and to a portion 45 of the top end 11 of the first panel 21 that faces the first fold 41. The heat sealing can be performed using a hot air impingement heating device to melt the first and second folds 41, 42, 44 simultaneously with the first panel 21 of the bag 10. For example, hot air nozzles can be inserted between the folded material and the first panel 21 of the bag 10 while the bag 10 is conveyed through the hot air impingement heating device. In an embodiment, the hot air nozzles are inserted between the first portion 43 of the first fold 41 and the portion 45 of the first panel 21 that faces the first fold 41. FIG. 5 shows that the bottom end 12 of the bag 10 also has a triple-fold, but as noted above, the bag 10 is not limited to this embodiment, and the bottom end 12 can be sealed any way known to one of ordinary skill. In one aspect, the hot air can have a temperature great enough to melt the surface of the thermoplastic material on the outside of the bag Then the top end 11 of the bag 10 can be moved by drive rollers such that the molten surfaces are fused together between pinch rollers, followed by cooling of the seal area to form a permanent bond. For example, the fused portion of the bag 10 can be cooled by a device, such as cooled weld rollers, after the hot air is applied. Preferably the first portion 43 of the first fold 41, the second portion 44 of the first fold 41, the second fold 42, and the portion 45 of the first panel 21 that faces the first fold 41 are substantially parallel to each other within the hot air heat seal.

As a result, the top end 11 of the bag 10 can be triple-folded and hot air heat sealed such that one or more of the following features can be present: (i) the sealed area extends all the way across the width of the bag 10, in particular along the gussets 25, if any; (ii) the bottom edge of the sealed area is firmly sealed down; (iii) penetrating grain-based insects are excluded from the interior of the bag 10.

As noted above, the thermoplastic material preferably comprises a layer of BOPP. Nevertheless, as non-limiting examples, the present inventors found that suitable hot air heat seals can be achieved by (i) material interfaces that do not decrease in x and y direction strength when exposed to heat; (ii) material layers that do not lose z-direction strength when exposed to heat, such as inks and co-extrusion lamination layers; (iii) interlaminate bond strengths of 600 g/in or greater according to ASTM F904 and ISO 11339:1993.

In an alternative embodiment, the triple-fold can be employed in combination with another type of sealing method besides heat sealing, for example adhesive applied while sealing or before sealing and reactivated with heat, a heat sealable coating, ultrasonic, induction sealing, cohesive sealing, or taping as another example.

To open the bag 10, a consumer pulls the folded material of the top end 11 of the bag 10 away from the portion 45 of the first panel 21 that faces the first fold 41. After the bag 10 is completely unfolded, the consumer can move the top edges of the first panel 21 and the second panel 22 away from each other to access the opening 15.

Figure 6A:
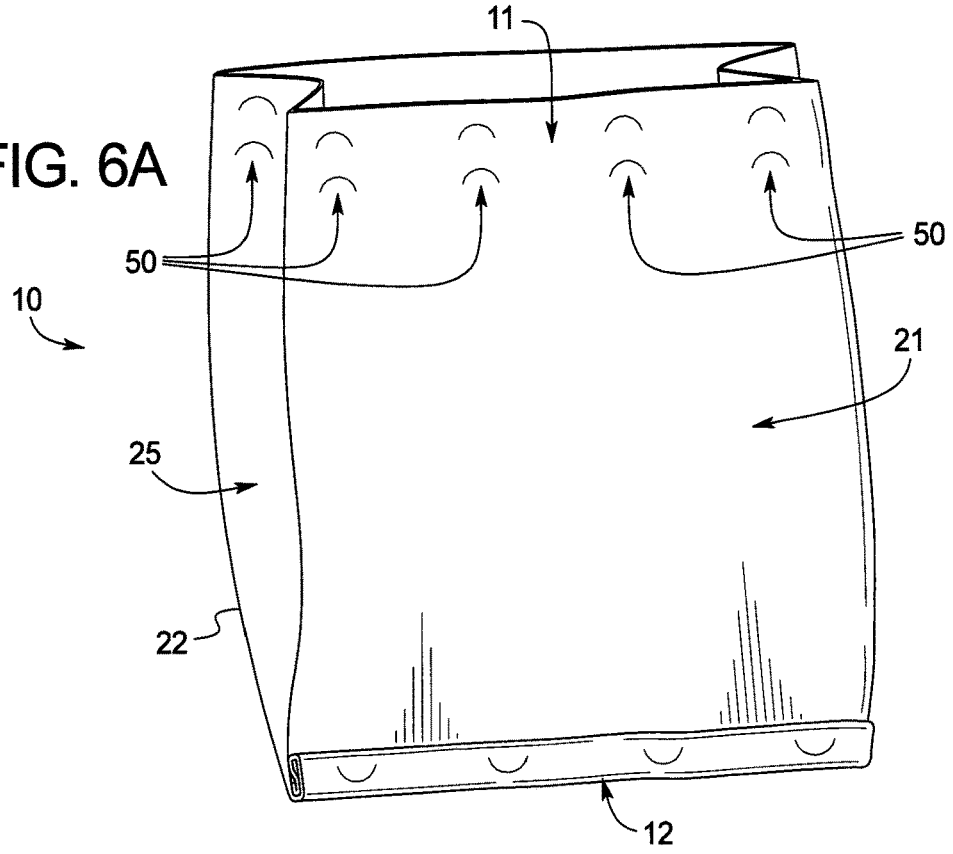
FIGS. 6A and 6B show front perspective views of a bag provided by the present disclosure in an unsealed configuration and a sealed configuration, respectively.
Figure 6B:
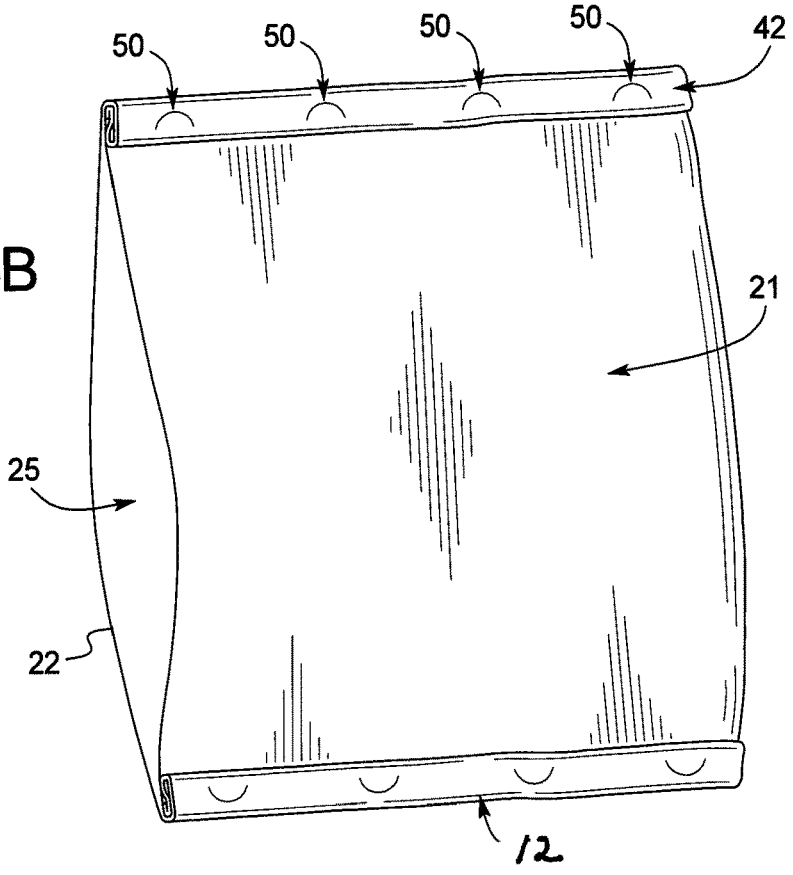

As shown in FIGS. 6A and 6B, vents 50 can be positioned in the folded and sealed area of the bag 10. The shape of each of the vents 50 can be a slit, an X, a crescent, a hole, or any other shape. The vents 50 can provide venting despite the triple-fold hot air seal that limits or prevents infestation. Air can escape through the vents by passing through the vents 50 in the folded area of the seal and then out of the open ends along the lateral sides 31, 32 of the bag 10. In this regard, the air coming out from the inside of the bag 10 is under pressure and, because of its low viscosity, is able to flow out; but water cannot flow through the vents 50 and insects cannot force their way through the folded material of the bag 10. In an embodiment, the vents 50 are half-moon shaped die cuts, but the vents 50 are not limited to any specific shape. Double-folded bags naturally vent because there is effectively only one fold to hinder air escaping through the seal area, and the folded material does not have a lot of deadfold and tends to be biased toward opening up, however this effect is decreased or eliminated by the triple-fold of the present disclosure.

The present inventors surprisingly found that the locations of the vents 50 that are depicted in FIGS. 6A and 6B, namely in the folded and sealed area of the bag 10, are effective against insect infestation in a double or triple folded and sealed bag while allowing sufficient air escape. The vents 50 can be located at any location within the hot air sealed portion of the bag 10, for example in one or more locations selected from (i) the portion 45 of the first panel 21 that faces the first fold 41 and to which the folded material is sealed by hot air, (ii) the part of the gussets 25 that is above the bottom edge of the first and second folds 41,42, (iii) the first portion 43 of the first fold 41, (iv) the second portion 44 of the first fold 41, for example along the edge of the opening 15 of the bag 10, and (v) the second fold 42.

Preferably at least a portion of the vents 50 are positioned at and/or proximate to the center of the bag 10 such that these vents 50 are about the same distance from the first side 31 as from the second side 32 of the bag 10. Alternatively or additionally, preferably at least a portion of the vents 50 are positioned in the gussets 25.

The number, shape and size of the vents 50 can vary depending on how fast the bag 10 must be vented. The location of the vents 50 can also vary as long as the vents 50 are within the sealed part of the bag 10.

In a specific embodiment, arc vents can be positioned on a flush-cut double fold or triple-fold polywoven bag near the center of the bag so that the vents do not interfere with suction cups of the bagging machinery during production. Locating the arc vents in the middle of a double-fold/triple-fold flush-cut bag can also have advantages of making it difficult for grain based insect infestation to travel the long path journey to enter through the flap of the arc vent and reducing the amount of odor escapement that attracts the insects. Additionally the arc vents can be spaced so that after the bag is trimmed from the end and then double- or triple-folded and sealed, at a minimum one vent will be exposed for exhausting air.

The flaps of the arc vents can be made during the bag converting process using existing machine capabilities, such as a laser or die punch. Including the arc vents during the converting process should not reduce supplier bag line speeds, and therefore not cause additional cost to the bag. Vents could also be created before or after the bag is filled using such methods as laser or die punch.

Arc vents are only one possible solution for venting in the triple-fold and seal closure. Holes or cuts of all sizes and shapes e.g. microperforations, slits, holes, and the like could all function equally well because of the torturous path nature of the vents being placed on the inside of the folded closure and because the location of the vents are so far from the ends of the seals.

Without being bound by theory, the present inventors believe that the success of the triple-fold and vented closure against insect infestation over the double fold and seal closure is due to the fact that the triple-fold effectively prevents insects from squeezing in between the inner layers of the bag at the cut end of the bag being folded. Especially critical are the outside edges of the heat seal that are directly exposed to insects. The location of the vents is toward the interior of the seal, within the folds, so that insects must be able to travel, squeeze and wedge themselves along a very long torturous path to gain access to the interior of the package.

The triple-fold, which is a narrower seal, has the advantage that the cut edge of the bag is folded down into the nozzle heat seal area so that it is effectively heat sealed shut. In a double-fold seal, the cut edge of the bag is still open because it is very difficult to get enough heat along the cut edge of the bag.

Figure 7:
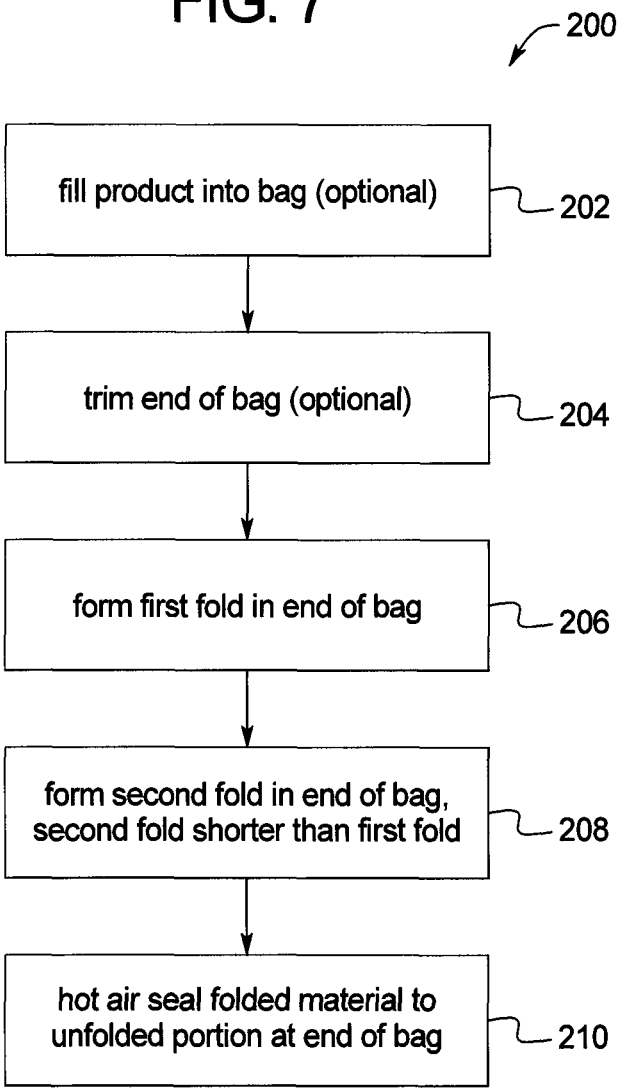
FIG. 7 shows a flowchart of an embodiment of a method provided by the present disclosure.

As shown in FIG. 7, the present disclosure provides a method 200 for sealing a thermoplastic package or bag ("the bag") and/or for packaging a product. In Step 202, which is optional, the product can be filled into the bag, for example through the top end of the bag after the bottom end has been sealed. The product can be one or more foods. For example, the one or more foods can be one or more animal foods, such as one or more companion animal foods. In an embodiment, the foods are selected from the group consisting of canine foods, feline foods and combinations thereof.

The bag can comprise vents that are positioned at and/or proximate to the center of the bag such that these vents are about the same distance from the first side of the bag as from the second side of the bag. The bag can comprise vents that are positioned in the gussets.

In Step 204, which is optional, an upper portion of the bag can be trimmed from the bag to ensure that the top end of the bag is substantially straight for subsequent processing. In Step 206, a first fold can be formed in the top end of the bag. The first fold can be a substantially rectangular portion of the bag and can have lateral sides substantially parallel to the lateral sides of the remainder of the bag. In Step 208, a second fold can be formed in the top end of the bag comprising the first fold. The second fold can be a substantially rectangular portion of the bag and can have lateral sides substantially parallel to the lateral sides of the remainder of the bag. The second fold has a height that is shorter than the height of the first fold. Forming the second fold in the bag comprises folding the first fold upon itself to form a first portion and a second portion of the first fold, and the second portion of the first fold is preferably folded onto the first portion of the first fold. Preferably Steps 206 and 208 are performed using only two folding mechanisms total.

Preferably Steps 206 and 208 are performed such that at least a portion of the vents are positioned in one or more locations selected from (i) the portion of the first panel that faces the first fold and to which the folded material is sealed by hot air, (ii) the part of the gussets, if any, that is above the bottom edge of the first and second folds, (iii) the first portion of the first fold, (iv) the second portion of the first fold, and (v) the second fold.

In Step 210, the first and second portions of the first fold and the second fold can be hot air sealed to each other and to the portion of the first panel that faces the first fold. The heat sealing can be performed using a hot air impingement heating device to melt the first and second folds simultaneously with the portion of the first panel that faces the first fold. The heat sealing can comprise inserting one more hot air nozzles between the folded material and the panel of the bag which the folds face, moving the top end of the bag between pinch rollers such that the molten surfaces are fused together by the pinch rollers, and the cooling the seal area to form a permanent bond. In an embodiment, the pinch rollers are cooled weld rollers. If the bag comprises vents, preferably at least a portion of the vents are positioned within the sealed material. In an alternative embodiment, the triple-fold can be employed in combination with another type of sealing method besides heat sealing, for example adhesive applied while sealing or before sealing and reactivated with heat, or taping as another example.

In an embodiment, the method comprises performing Steps 106, 108 and 110 on the bottom end of the bag, before or after these steps are performed on the top end of the bag as described above.

In another aspect, the present disclosure provides a method for reducing or preventing insect infestation of a woven thermoplastic package or bag ("the bag"). The method comprises (i) optionally filling a product into the bag; (ii) optionally trimming an upper portion of the bag from the bag; (iii) forming a first fold in the top end of the bag; (iv) forming a second fold in the top end of the bag comprising the first fold, the second fold having a height that is smaller than the height of the first fold, and forming the second fold in the bag comprising folding the first fold upon itself to form a first portion and a second portion of the first fold, the second portion of the first fold preferably folded onto the first portion of the first fold; (v) and hot air-sealing the first and second portions of the first fold and the second fold to each other and to the portion of the bag that faces the first fold, for example with a hot air impingement heating device that can comprise one more hot air nozzles inserted between the folded material and the panel of the bag which the folded material faces and that can comprise pinch rollers that fuse the molten surfaces together. In an embodiment, the method comprises performing steps (iii), (iv) and (v) on the bottom end of the bag, before or after these steps are performed on the top end of the bag as described above.

Figure 8:
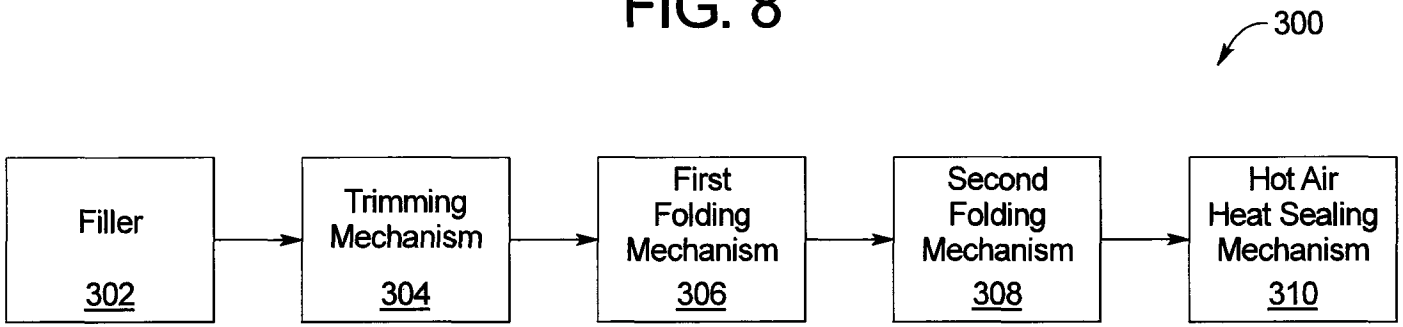
FIG. 8 is a schematic diagram of an exemplary device that can be used to make an embodiment of a sealed thermoplastic bag provided by the present disclosure.

FIG. 8 is a non-limiting schematic diagram of an exemplary device 300 that can be used to make any of the sealed thermoplastic bags disclosed herein, including the bag 10. The device 300 can comprise a filler 302 which can fill product into a thermoplastic bag. The device 300 can further comprise a trimming mechanism 304 which can trim an upper portion of the bag from the bag to ensure that the top end of the bag is substantially straight for subsequent processing. Preferably the trimming mechanism 304 is downstream from the filler 302.

The device 300 can comprise a first folding mechanism 306 which can form a first fold in the bag, for example the first fold 41. The device 300 can comprise a second folding mechanism 308 which is downstream of the first folding mechanism 306 and can form a second fold in the bag, for example the second fold 42. The first and second folding mechanisms 306,308 are configured such that the second fold has a height less than the height of the first fold. Consequently, forming the second fold comprises folding the second fold upon itself, the first folding being divided into a first portion and a second portion which is folded onto the first portion. Preferably the first and second folding mechanisms 306,308 are the only folding mechanisms in the device 300 and preferably the device 300 is configured for the bag to pass through the first folding mechanism 306 only once and through the second folding mechanism 308 only once.

EXAMPLES

The following non-limiting examples present experimental evidence of the venting of a sealed woven thermoplastic bag while also preventing infestation thereof as achieved by embodiments provided by the present disclosure.

Examples 1 and 2

The present inventors carried out two separate infestation studies on woven polypropylene bag seals. Stored grain insect pest infestation in packaging is defined to be when insect adults or larvae are able to gain access to the interior of a sealed package. The degree of infestation is measured by hand-counting both larvae and adult insects, and this number is reported as the total number of insects inside the package after exposure of the sealed package to a room filled with insects after two weeks. The greater the number of insects that have penetrated the package, the less resistant to infestation are the seals.

Example 1

Forty full bags of the two types of bags were filled with 16 lbs of petfood. There were two different types of bags with the following seals tested: (i) double fold and tape seal, (ii) double fold and heat seal.

The bags were then exposed to thousands of each of five different types of insects for two weeks in a chamber. After two weeks, the bags were opened and the total number of adult and larval insects were counted by hand.

Results are shown in Table 1 and show that the double-fold heat sealed bags better resist infestation compared to typical industry double folded and taped bags.

TABLE 1

| Woven Polypropylene Bag Description | Total Insects Per Bag after 2 Weeks |
|---|---|
| Typical industry double folded bags tape sealed on both ends | 496 |
| Double fold and heat sealed top and bottom | 16 |

Example 2

Forty each of cut in half woven bags with a particular test-sealed end were filled with 7 lbs of petfood. Then the open end of the bag was sealed in such a way to prevent any insects from entering through that end (i.e. the only way for the insects to enter the bag was through the test sealed ends). The bag seals that were tested were: (i) triple-fold heat sealed without venting, (ii) triple-fold heat sealed with venting, and (iii) Heat sealed stepped pinch without venting; and (iv) Heat sealed stepped pinch with venting.

The bags were exposed to thousands of two of the most invasive insect pest varieties over two weeks, and then the bags were opened and the number of adult and insect larvae was counted by hand.

The results are shown in Table 2 which shows that the triple-fold seal according to the present disclosure, with or without venting, gave a significantly better infestation resistant seal than other types of heat seals.

TABLE 2

| Woven Polypropylene Bag Seal Description | Total Insects Per Bag after 2 Weeks |
|---|---|
| Triple Fold Heat seal, no vents | 0 |
| Triple Fold Heat seal, vented | 0 |
| Heat sealed stepped pinch bag, no vent | 25 |
| Heat sealed stepped pinch bag, vented | 33 |

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A method for sealing a thermoplastic bag comprising:

forming a first fold in a top end of the bag, the top end of the bag including a first panel and a second panel;

forming a second fold in the top end comprising the first fold;

folding the first fold to form a first portion of the first fold and a second portion of the first fold, the second portion of the first fold is folded onto the first portion of the first fold; and heat sealing the first fold and the second fold to each other and to a portion of the bag that faces the first fold, the heat sealing comprising applying hot air to the bag.

2. The method of claim 1 wherein the second fold has a height that is less than a height of the first fold.

3. The method of claim 1 wherein the forming of the second fold folds the first fold to form the first and second portions of the first fold.

4. The method of claim 1 wherein the first portion of the first fold, the second portion of the first fold, and the second fold are formed using only two folding operations.

5. The method of claim 1 wherein the hot air is applied directly to the portion of the bag that faces the first fold.

6. The method of claim 1 wherein the hot air is applied directly to the first portion of the first fold.

7. The method of claim 1 comprising subjecting the top end of the bag to a cooling device after the hot air has been applied.

8. The method of claim 1 wherein the hot air has a temperature great enough to melt the surface of the thermoplastic material on the outside of the bag.

9. A method for packaging a product comprising:

filling the product into a thermoplastic bag that comprises a first panel, a second panel opposite to the first panel, and vents;

forming a first fold in a top end of the thermoplastic bag including the first panel and the second panel;

forming a second fold in the top end comprising the first fold, the second fold having a height that is less than a height of the first fold, the first fold and the second fold are formed such that a portion of the first panel faces the first fold and such that at least a portion of the vents are positioned in a section of the bag selected from the group consisting of the first fold, the second fold, the portion of the first panel that faces the first fold, and combinations thereof; and applying hot air to the thermoplastic bag to heat seal the first fold and the second fold to each other and to the portion of the first panel that faces the first fold.

10. The method of claim 9 wherein the bag comprises gussets that connect the first panel to the second panel, and the forming of the second fold positions a portion of the vents in a part of the gussets that is above a bottom edge of the second fold.

11. The method of claim 9 wherein the forming of the second fold comprises folding the first fold to form a first portion and a second portion of the first fold, the second portion folded onto the first portion.

12. The method of claim 11 wherein the applying of the hot air comprises sealing a bottom edge of the second portion of the first fold at a position between the second fold and the first portion of the first fold, and the bottom edge of the second portion of the first fold comprises an opening of the bag that is closed by the heat seal and accessed by pulling the first and second folds away from the portion of the first panel that faces the first fold.

13. A method for reducing or preventing insect infestation of a woven thermoplastic bag forming a first fold in a top end of the bag, the top end including a first panel and a second panel;

forming a second fold in the top end comprising the first fold;

folding the first fold to form a first portion of the first fold and a second portion of the first fold, the second portion of the first fold is folded onto the first portion of the first fold; and heat sealing the first fold and the second fold to each other and to a portion of the bag that faces the first fold, the heat sealing comprising applying hot air to the bag.

* * * * *